US008936010B2

(12) United States Patent
Costa et al.

(10) Patent No.: US 8,936,010 B2
(45) Date of Patent: Jan. 20, 2015

(54) FUEL HEATER WITH FUSE EFFECT

(75) Inventors: Eduardo Dos Santos Costa, Campinas-SP (BR); Marcelo Renato Cavaglieri, Indaiatuba-SP (BR); Guilherme Henrique Mayer Alegre, Jundiai-SP (BR); Cleber De Jesus Lopes, Indaiatuba-SP (BR); Marco Aurelio Duduch, Campinas-SP (BR); Fernando Luiz Windlin, Jundiai-SP (BR)

(73) Assignee: Magneti Marelli Sistemas Automotivos Industria E Comercio Ltda, Hortolandia (BR)

( * ) Notice: Subject to any disclaimer, the term of this patent is extended or adjusted under 35 U.S.C. 154(b) by 293 days.

(21) Appl. No.: 13/371,206

(22) Filed: Feb. 10, 2012

(65) Prior Publication Data

US 2012/0204843 A1 Aug. 16, 2012

(30) Foreign Application Priority Data

Feb. 11, 2011 (BR) ..... 1100311

(51) Int. Cl.
*F02M 53/02* (2006.01)

(52) U.S. Cl.
USPC ..... 123/557; 123/549

(58) Field of Classification Search
USPC ..... 123/557, 549, 179.21
See application file for complete search history.

(56) References Cited

U.S. PATENT DOCUMENTS

| | | | | |
|---|---|---|---|---|
| 3,687,122 | A * | 8/1972 | Kamo | 123/550 |
| 5,216,990 | A * | 6/1993 | Moosmann et al. | 123/145 A |
| 5,392,749 | A * | 2/1995 | Stockner et al. | 123/470 |
| 5,529,035 | A * | 6/1996 | Hunt et al. | 123/179.15 |
| 5,664,547 | A * | 9/1997 | Klak et al. | 123/549 |
| H1820 | H * | 12/1999 | Graves et al. | 123/557 |
| 8,069,845 | B2 * | 12/2011 | Ulrey et al. | 123/553 |
| 2004/0144370 | A1 * | 7/2004 | Mey et al. | 123/527 |
| 2009/0107473 | A1 * | 4/2009 | Imoehl et al. | 123/549 |
| 2009/0133676 | A1 * | 5/2009 | Lepsch et al. | 123/549 |
| 2009/0241915 | A1 * | 10/2009 | Sales | 123/549 |

* cited by examiner

*Primary Examiner* — M. McMahon
(74) *Attorney, Agent, or Firm* — Volpe and Koenig, P.C.

(57) ABSTRACT

A fuel heater is provided to heat fuel with a safety feature (fuse effect). The internal combustion engine can be operated with ethanol, gasoline or a mixture of ethanol and gasoline. The fuel heater is an integrant part of the electronic injection system of internal combustion engines. The fuel heater is assembled inside the fuel rail and serves to increase fuel temperature before, during and after ignition at temperatures specified by the engine calibration strategy.

1 Claim, 7 Drawing Sheets

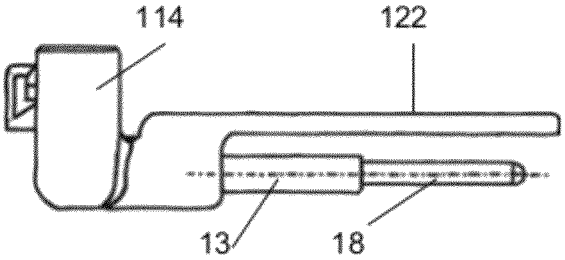
Figura 6
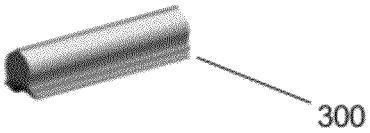
Figure 7
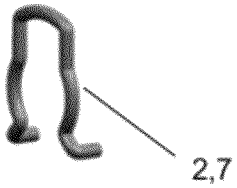
Figure 8
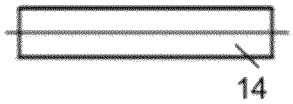
Figure 9
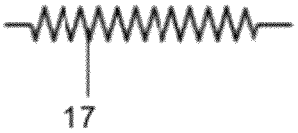
Figure 10
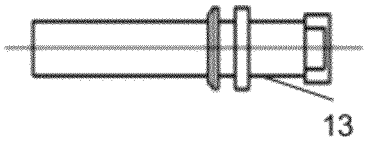
Figure 11
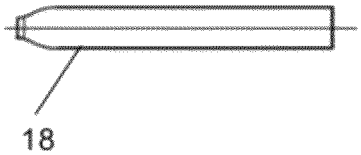
Figure 12
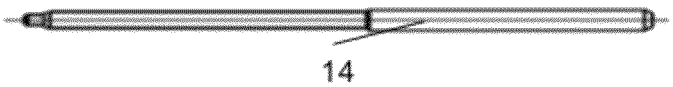
Figure 13
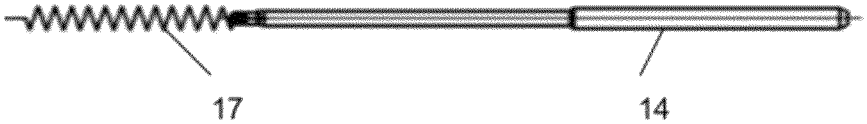
Figure 14

FUEL HEATER WITH FUSE EFFECT

RELATED APPLICATION

The present application hereby claims priority under 35 U.S.C. Section 119 to Brazilian Patent application number PI 1100311-1, filed Feb. 11, 2011, the entire contents of which are hereby incorporated by reference.

FIELD OF INVENTION

The present invention discloses a device to heat fuel with a safety feature known as fuse effect. Said device operates on ethanol, gasoline or a mixture of ethanol and gasoline, being part of the electronic injection system of internal combustion engines—ICE.

The device is assembled inside the fuel rail and its function is to increase fuel temperature before, during and after ignition at low temperatures

BACKGROUND

With advancements in Flex Fuel technology, the use of ethanol for ICE has increased in the past few years. This means lower cost in comparison with the use of gasoline or diesel fuels and also a benefit to the environment when the results of discharge gas emissions are analyzed. However, automotive engines operating with ethanol have ignition difficulties when the temperature is below 15° C. due to the ethanol vaporization pressure be very low and its flash point be higher than operating with gasoline. For this reason, current systems have a secondary tank (202) containing gasoline which is used to start engine when its temperature is below 15° C., as seen on FIG. 1. As schematically represented in FIG. 1, this start up system comprises a reservoir (202), a supply pump (205) with adequate gasoline flow, feeding pipes (207) to a gasoline dosage valve (206), a mini fuel rail (203) required to supply dosed gasoline to the pipes of the intake manifold, calibrated-roles inserts (204) for an appropriate spraying of gasoline into the cylinders, and an engine intake manifold (201).

In Brazilian patent PI 0504015-9 by Márcio Turra de Ávila and Marcelo Valente Feitosa, the solution found for cold ignition was the use of an independent system, provided with a heating coil, and the use of an injector (or fuel injector, or atomizer) for the secondary fuel. With that solution, the number of fuel injectors to inject gasoline into the intake manifold or engine will always be a multiple of the number of fuel injectors used for ethanol injection. In this kind of solution, the problem is the high cost of the system due to the use of two fuel injectors, one for cold ignition of gasoline and another for the normal operation of the engine, for each engine cylinder.

Brazilian patent PI 0703443 by Ademar Rudge Filho discloses a solution using a system with a fuel rail to distribute fuel for cold ignition to the injector, wherein there is an exclusive injector for cold ignition for each engine cylinder. The great disadvantage of this system is the high cost due to the use of an additional injector for each engine cylinder solely dedicated to the cold ignition of the engine at low temperature.

Brazilian patent PI 0705422-0 by Gino Montanari et al discloses a tube device of heat diffusion passive regulation connected to one or more heating devices and inserted into a fuel supply primary rail in an ethanol cold start system.

Brazilian patent MU 8403382-7 by Eduardo Augusto de Campos discloses a controlled heating device for the body of the main fuel injector, reporting that it has great technical and functional advantages over conventional ignition systems with gasoline.

Brazilian patents PI 0403039-7 and P040104172 by Eduardo Augusto de Campos disclose the whole strategy of the ethanol cold start system, reporting the concept of the utilization of a heating device for fluid fuel which is activated by a signal coming from a sensor installed on the vehicle door or another kind of signal. The device object of this patent application is an integrant part of the invention strategy disclosed. The author, Eduardo Augusto de Campos, also discloses in Brazilian patents PI0405182 and PI 0405181, possible configurations to heat the fluid fuel of the cold start system.

Brazilian patent PI 0805484-3 by Akio Omori et al discloses the way of axial installation of heating devices in a primary fuel supply rail of the no-return kind, which increases the homogeneity of the heat flow in a cold start system with ethanol ECS®. The device object of this patent application, is an integrant part of this invention disclosed.

The heating device assembled inside the fuel rail is designed to transform electric energy into thermal energy (Joule effect) transferring its heating potential to the fuel present inside the chamber to be later transported heated and to be sprayed to engine cylinders by fuel injectors.

U.S. Patent Application Publication No. 2009/0308362.A1 by Jens Schneider et al discloses a heater whose resistance element is in a powder composed of insulating and refractory material, which is inserted into a metal tube shaped to compress the powder on the resistance element. Other devices with similar functions have already been patented and manufactured by several corporations, both in Brazil and abroad, but they do not have the safety feature (fuse effect) required to guarantee the integrity of the system in case of control failure in the electronic control unit (ECU). Said function is even more important in applications where fuel rails are made of polymeric materials.

SUMMARY

An objective of the fuel heater with fuse effect, of the present invention is to transform electric energy into thermal energy (Joule effect) transferring, as much as possible, its heating potential to the fuel present inside the chamber to be later transported heated and to be sprayed to engine cylinders by fuel injectors.

Another objective of such device, is directed to safety, by the introduction of a fragile resistance element designed to break, under critical operation conditions, in a time that can guarantee the integrity/leakproofness of the fuel rail made of plastic material.

A further objective of said device, is to reduce exhaust pollutant gas emissions by improving combustion efficiency in the engine, both at the time of ignition and also in the post-ignition period, when the cold fluid from the fuel tank would be in contact with the warming up engine.

A still further objective of said device, but no less important, is the fact that it has positive and negative terminals, to allow its use in applications where fuel rails are made of polymeric materials.

The fuel heater with fuse effect is assembled in the cold ignition system (CI) for ethanol, placed in axial direction, but not solely, inside the fuel rail set. The heating region is formed by a thin wall metal tube containing a heating device within it. Said element is covered by a mineral, such as magnesium oxide (MgO), compressed by the metal tube. Other embodiments with the same characteristics of MgO can also be used.

The heating device is also designed to have a characteristic curve of premature degradation in case of any failure in the control system (FIG. 30), involving either the electronic control unit or the power module used for switching. The device at issue dissipates electric power P consuming an electric current I when submitted to electric voltage E. Variations of the physical quantities mentioned may occur due to changes in application, i.e., in the volume or geometry of the fuel rail and/or tolerances in manufacturing/industrialization processes.

After detecting the ignition intention of the driver, the electronic control unit starts to control the fuel heater with fuse effect by the power module according to the temperature of the engine cooling fluid, and using as a reference the ambient temperature determined by the Tmap sensor installed in the engine air intake system. The signal sent by the electronic control unit to the heating control at issue may be either continuous or discreet, and it may present a quadratic wave with duty cycle variations depending on the kind of cycle required or any other characteristic that may become necessary to optimize the performance and/or adequation to new project requirements.

BRIEF DESCRIPTION OF THE DRAWINGS

The present invention will be better understood in the light of the attached figures, given as mere examples, but not limitative, wherein:

FIG. 6—refers to the view of the fuel heater with a solution of direct welding to the fuel rail;

FIG. 7—refers to the tridimensional view of a volume reducer existing in the fuel rail, which can be eliminated with the solution presented in FIG. 6;

FIG. 8—refers to the tridimensional view of the heater assembly lock spring in the fuel rail, which can be eliminated with the solution presented in FIG. 6;

FIG. 9—refers to the view of the external metal tube that compacts the insulating mineral MgO in its primitive production stage;

FIG. 10—refers to the view of the heating element designed to work as fuse effect and guarantee the integrity of the system;

FIG. 11—refers to the view of the main metal body of the fuel heater;

FIG. 12—refers to the view of the external metal tube that compacts the insulating mineral MgO;

FIG. 13—refers to the view of the metal rod that transmits the electric current to the heating element of FIG. 12;

FIG. 14—refers to the view of the assembly of the heating element designed to work as fuse effect in the metal rod that transmits the electric current;

DETAILED DESCRIPTION OF THE PREFERRED EMBODIMENTS

The present application will be exemplified for a conventional feeding system for cold ignition on a conventional internal combustion engine supplied with alcohol, gasoline or a mixture of gasoline and alcohol. This example is non limitative and is disclosed for a four cylinder engine, and it may be adapted to vehicles with more or fewer cylinders, as required. As known, the fuel supply system of a vehicle comprises a reservoir for the fuel (alcohol, gasoline or its mixtures), a pump for feeding the fuel within the reservoir to a fuel rail, said fuel rail receiving four injectors each one designated to spread or inject a quantity of fuel inside a respective cylinder or a respective pipe of an intake manifold (direct injection system or indirect injection system). The quantity of fuel to be spread or injected inside each cylinder is controlled by an ECU as a function of the driver commands to the vehicle (pressure in the gas pedal) among others known parameters. The fuel supply system may also comprise a filter in order to avoid impurities to reach the fuel rail.

Figure 1:
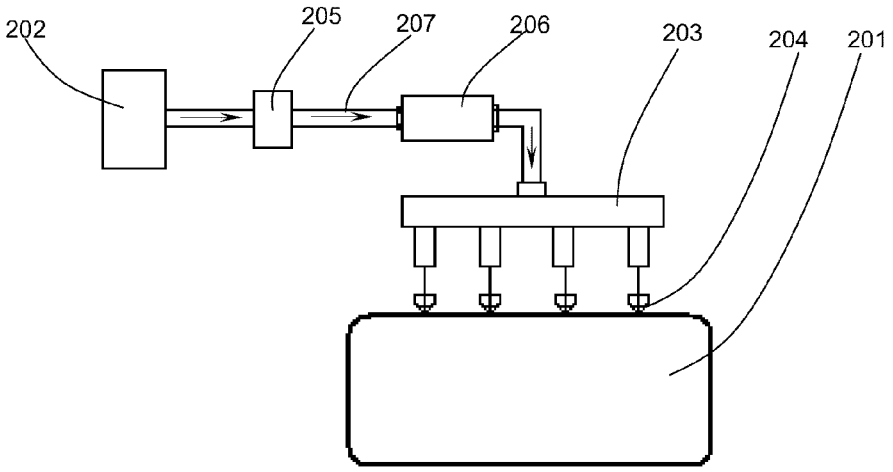
FIG. 1—schematically represents the conventional feeding system of gasoline for cold start, showing the reservoir, fuel pump for appropriate flow, feeding pipes, fuel dosage valve, mini fuel rail for fuel distribution, calibrated inserts and engine intake manifold.
Figure 2:
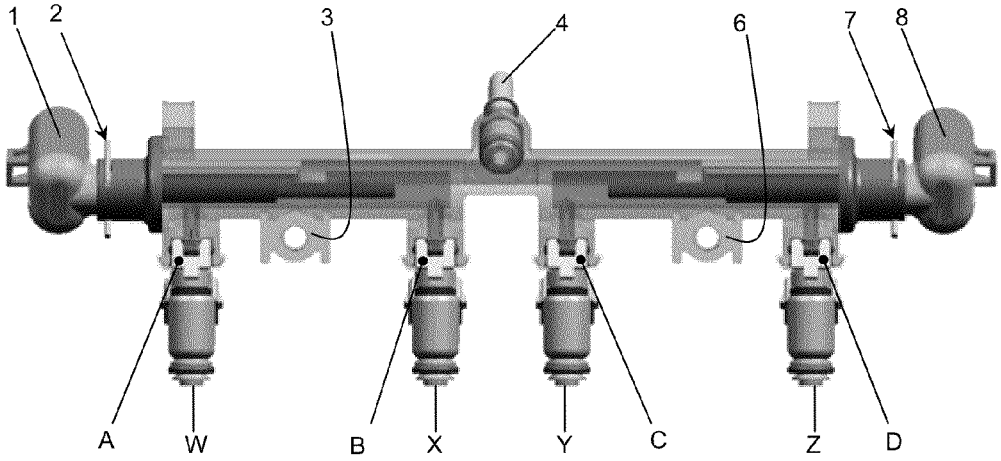
FIG. 2—shows a transparent tridimensional view of the fuel rail set, where the elements of the present invention are shown, particularly the left fuel heater with fuse effect and its other components.

FIG. 2 presents a tridimensional cross section view of the fuel rail set, representing the left fuel heater (1) with fuse effect, object of the present invention, the lock spring (2) to hold the left fuel heater (1) with fuse effect, the right holding bush (3) of the rail set in the vehicle intake manifold, the fuel inlet tube (4), the plastic rail body (5), the left holding bush (6) of the rail set in the vehicle intake manifold, the lock spring (7) to hold the right fuel heater (8) with fuse effect, the lock springs (A, B, C, D) to hold the fuel injectors sets (W, X, Y, Z). For the purposes of present invention, fuse effect is to be understood as having a behavior similar to an over temperature protective component or fuse. In other words, as an electric current flows through a metallic element (the heating element 17, in present invention), it warms up (Joule effect) until its break down temperature. This way, the current path is interrupted so avoiding other damages.

Figure 3:
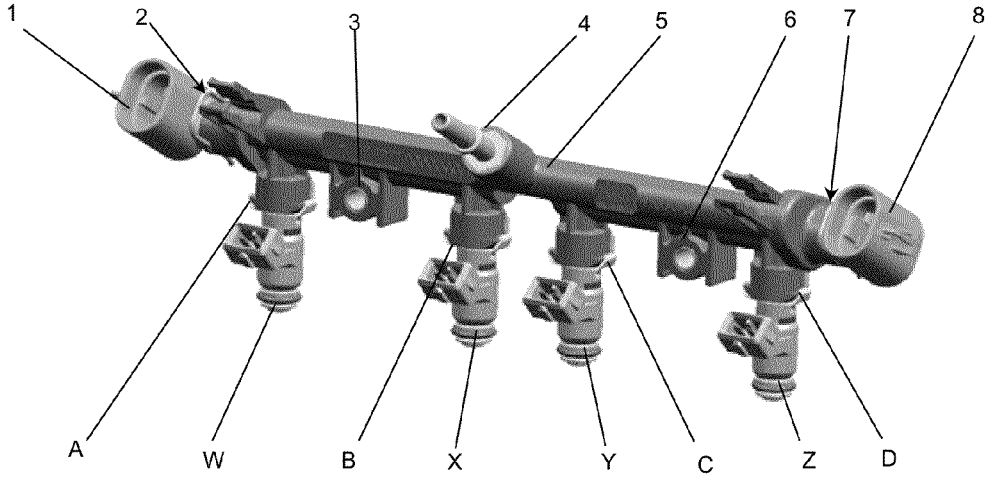
FIG. 3—shows a tridimensional view of the fuel rail set that distributes and supplies fuel to the engine, including the left fuel heater with fuse effect of the present invention.

FIG. 3 refers to the tridimensional view of the rail set of FIG. 2, wherein we can see fuel heaters (1, 8) with fuse effect, lock springs (2, 7) to hold the heaters (1, 8), fuel inlet tube (4), plastic rail body (5), left holding bush (3, 6) for the rail set in the vehicle intake manifold and lock springs (A, B, C, D) to hold the fuel injectors sets (W, X, Y, Z).

Figure 4:
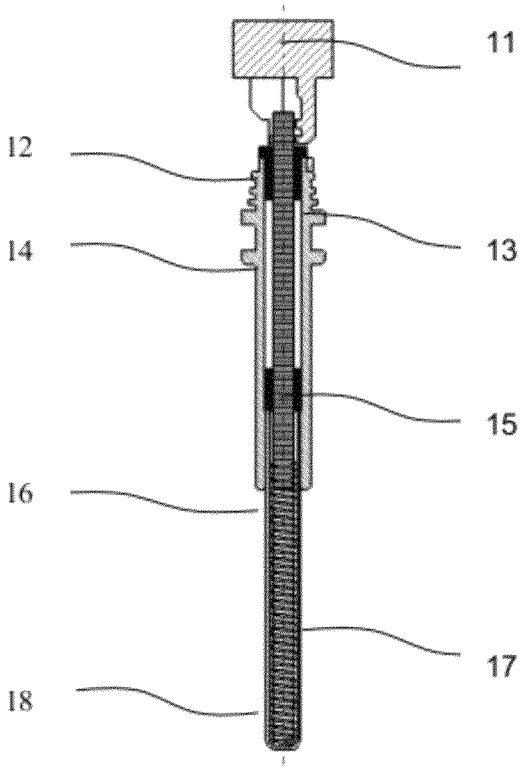
FIG. 4—refers to the cross section view of the fuel heater with fuse effect.

To better detail the invention, FIG. 4 shows a cross section view of the fuel heater (1, 8) with fuse effect that transforms electric energy into thermal energy (Joule effect) with high performance and also to protect the system under critical operation conditions. The following are represented:

connector (11, 111) housing a set of terminals (112) which receives electric energy incoming from the battery and controlled by the electronic control unit by a power module with switching function;

insulating ceramic gasket (12) which insulates the terminal electric contacts and it is made of said material or similar, to support the temperature of the terminal welding process in the inner rod (14);

main metal body (13) which protects the inner metal rod (14) and provides support to the whole set, it is manufactured in stainless material or any other material with similar properties to resist the corrosive action of the fluid fuel;

inner metal rod (14) which conducts the electric current from the terminals to the heating element (17) in spiral shape;

sealing gasket (15) of the insulator, preferably a mineral and, more preferably, MgO, which guarantees that there is no leakage or deterioration of said insulating mineral (MgO) from inside the heating capsule to the main metal body (13);

electric insulator (16), preferably a mineral and more preferably MgO, which insulates electrically the heating element (17) in spiral shape, which can be manufactured in magnesium oxide (MgO) or any other material with similar properties;

heating element (17) designed to work as fuse effect by means of the alloy or geometry to transform electric energy into thermal energy (Joule effect) with high performance and also to protect the system under critical control conditions;

external metal tube (18) which compacts the insulator and also transmits to the fuel, by direct contact, the heat received from the heating element in spiral shape (17), which is made in stainless material or any other material with similar properties to resist the fluid fuel.

Figure 5:
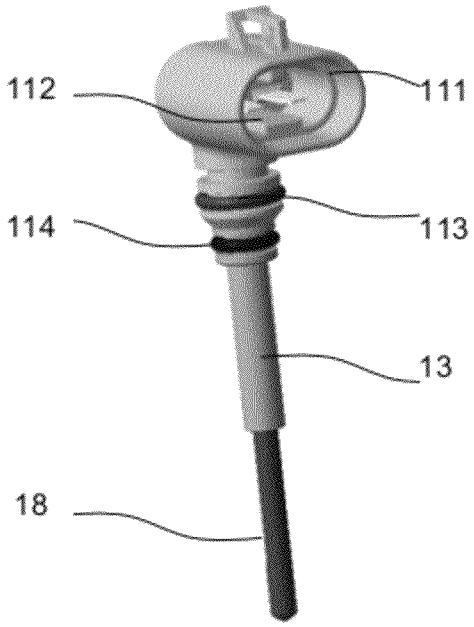
FIG. 5—refers to the tridimensional view of the fuel heater with fuse effect of FIG. 4.

The tridimensional view of the fuel heater with fuse effect represented by FIG. 5 shows the connector (111) which provides support to the set of terminals (112) and allows appropriate assembly of the plastic rail body (5) as shown by FIGS. 2 and 3. The larger sealing ring (113) which guarantees leakproofness of the assembly of the heater and the smaller sealing ring (114), also to guarantee no leakage of the assembly of the heater as per FIG. 29 at the fuel rail as per FIG. 3, performing a double safety feature, are also shown. We can also see from the outside the main metal body (13) and the external metal tube (18) which has direct contact with the fuel.

In an alternative configuration, the fuel heater can use a direct welding solution in the fuel rail. In this case, the sealing rings (113, 114), the lock springs (2, 7) of FIG. 8 and the volume reducer (300) of the fuel rail of FIG. 7 can be eliminated. As shown in FIG. 6, said solution intends that the connector (111) have a main plastic body (122), able to be directly welded to the rail body (5), the main metal body (113) and the external metal tube (114) that transmits heat to the fluid fuel.

Figure 15:
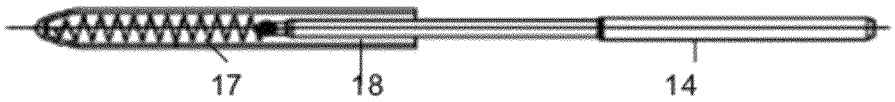
FIG. 15—refers to the cross section view of the assembly of the external metal tube that compacts the insulating mineral MgO in the subset of FIG. 16.
Figure 16:
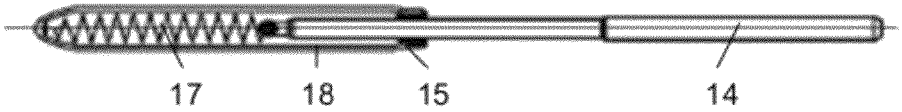
FIG. 16—refers to the cross section view of the compacted insulating mineral MgO through the external metal tube in the subset of FIG. 16 and subsequent assembly of the sealing gasket of MgO.
Figure 17:
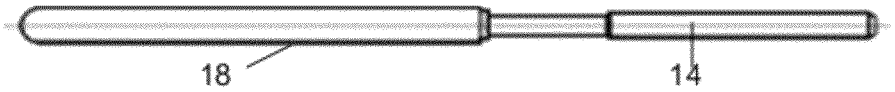
FIG. 17—refers to the view of the final assembly of the external metal tube that compacts the insulating mineral MgO in the inner metal rod.
Figure 18:
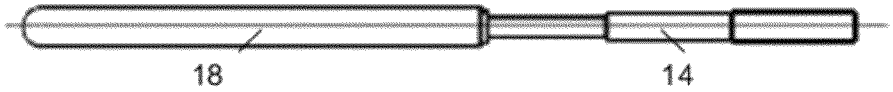
FIG. 18—refers to the conformation view of the inner metal rod.
Figure 19:
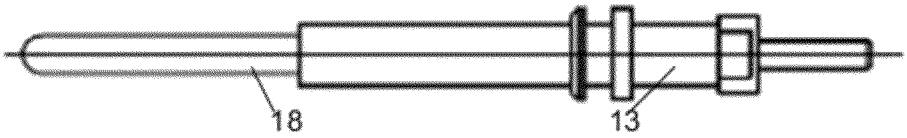
FIG. 19—refers to the assembly view of the main metal body in the subset of FIG. 20.

The set of FIGS. 9 to 19 shows in cross sections the various parts of the fuel heater with fuse effect (1, 8) and can be described as follows:

FIG. 9—refers to the view of the external metal tube (18) that compacts the insulating mineral MgO in its primitive manufacture stage;

FIG. 10—shows the heating element (17) designed to work as fuse effect and guarantee the integrity of the system;

FIG. 11 shows the main metal body (13) of the fuel heater (1, 8);

FIG. 12 shows the external metal tube (18) that compacts the insulating mineral after the first manufacturing/shaping process;

FIG. 13 shows the metal rod that transmits the electric current to the heating element (17);

FIG. 14 shows the assembly of the heating element (17) designed to work as fuse effect in the metal rod (14) that transmits the electric current;

FIG. 15 shows the cross section view assembly of the external metal tube (18) that compacts the insulating mineral (MgO) in the subset of FIG. 14;

FIG. 16 shows the electric insulator (16) made of insulating mineral through the external metal tube (18) in the subset of FIG. 14 and subsequent assembly of the sealing gasket (15);

FIG. 17 shows the external view of the final assembly of the external metal tube (18) in the inner metal rod (14);

FIG. 18 shows the external view of the shaping assembly of the inner metal rod (14);

FIG. 19 shows the external view of the assembly of the main metal body (13) in the subset of FIG. 18.

Figure 20:
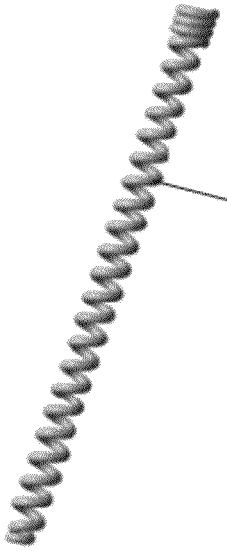
FIG. 20—refers to the tridimensional view of the heating element designed to work as fuse effect.
Figure 21:
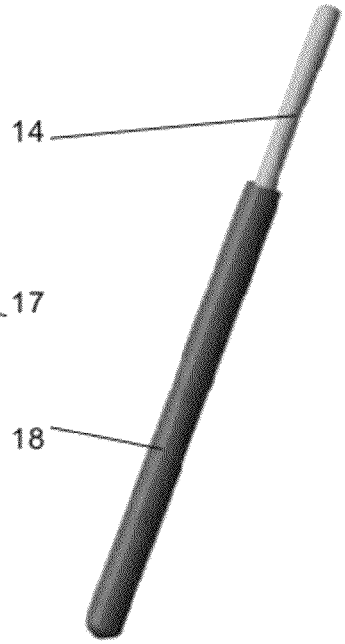
FIG. 21—refers to the tridimensional view of the final assembly of the external metal tube in the inner metal rod.
Figure 22:
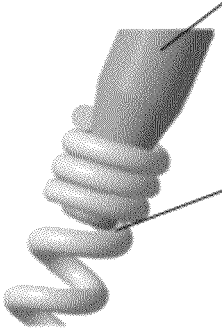
FIG. 22—refers to the tridimensional view of the assembly of the inner metal rod in the heating element designed to work as fuse effect.
Figure 23:
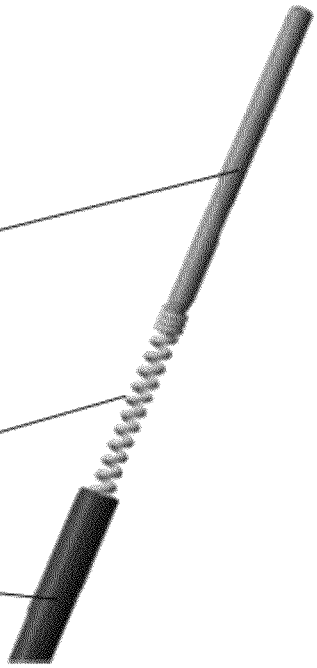
FIG. 23—refers to the tridimensional view of the compacted insulating mineral inside the subset of FIG. 23.
Figure 24:
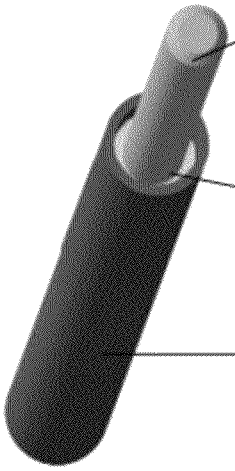
FIG. 24—refers to the tridimensional view of the assembly of the subset of FIG. 24 in the external metal tube.
Figure 25:
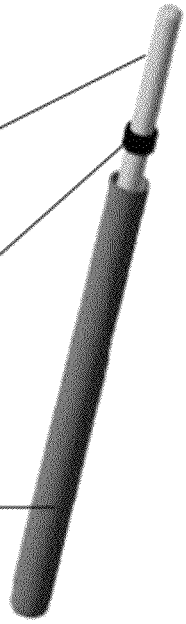
FIG. 25—refers to the tridimensional view of the subset of the inner metal rod, of MgO sealing gasket and of the external metal tube.
Figure 26:
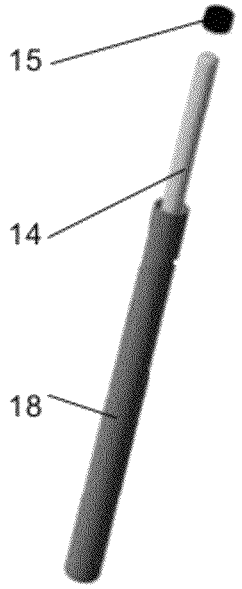
FIG. 26—refers to the tridimensional view of the set of the sealing gasket in the subset of FIG. 23.
Figure 27:
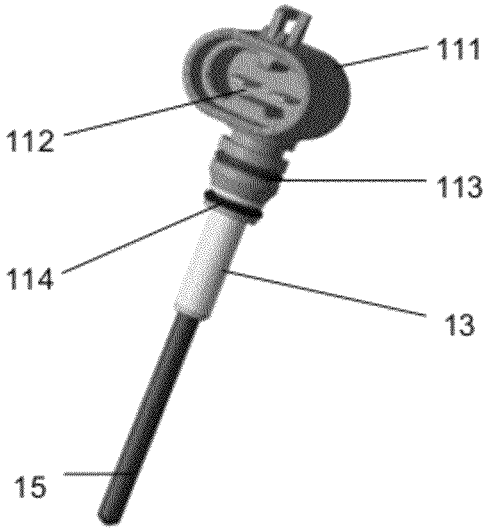
FIG. 27—refers to the tridimensional view of the fuel heater after the assembling process.
Figure 29:
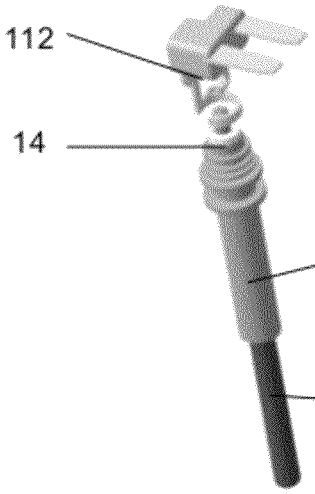
FIG. 29—refers to the tridimensional view of the assembly of the terminals subset in the subset containing the inner metal rod+the insulating ceramic gasket+the main metal body+the external metal tube.
Figure 28:
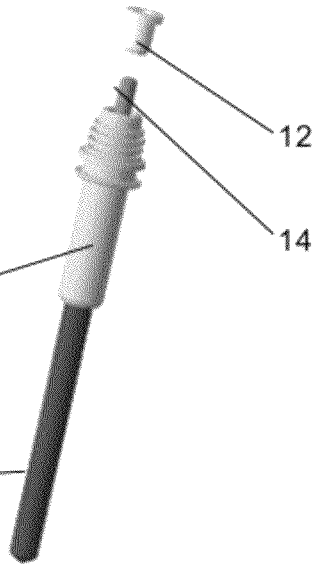
FIG. 28—refers to the tridimensional view of the assembly of the insulating ceramic gasket in the subset containing the inner metal rod, the main metal body and the external metal tube.

FIGS. 20 to 29 show in tridimensional views, some of which exploded, the several parts of the fuel heater with fuse effect (1, 8) and can be described as follows:

FIG. 20 shows the tridimensional view of the heating element (17) designed to work as fuse effect;

FIG. 21 shows the tridimensional view of the final assembly of the external metal tube (18) that compacts the insulating mineral (MgO) of electric insulator (16) in the inner metal rod (14);

FIG. 22 shows the tridimensional view of the assembly of the inner metal rod (14) in the heating element (17) designed to work as fuse effect;

FIG. 23 shows the tridimensional view of compacted insulating mineral of electric insulator (16) inside the subset of FIG. 21;

FIG. 24 shows the tridimensional view of the assembly of the subset of FIG. 22 in the external metal tube (18);

FIG. 25 shows the tridimensional view of the subset of the inner metal rod (14), the sealing gasket (15) for the electric insulator (16) and the external metal tube (18);

FIG. 26 shows the tridimensional view of the assembly of the insulating gasket (12) in the subset of FIG. 21;

FIG. 27 shows the tridimensional view of the fuel heater after the assembling process, showing: connector (111), the set of terminals (112), the larger sealing ring (113), the smaller sealing ring (114), and the main metal body (13);

FIG. 28 shows the tridimensional view of the insulating ceramic gasket set (12) in the subset containing the inner metal rod (14) of the main metal body (13) and the external metal tube (15) that compacts the electric insulator (MgO) (16);

FIG. 29 shows the tridimensional view of the assembly of the terminal subset (112) in the subset containing the inner metal rod (14), the insulating ceramic gasket (12), the main metal body (13) and the external metal tube (18) that compacts the electric insulator (16).

The fuel heater is designed to have a characteristic curve of premature degradation in case of any failure in the control system, involving both the electronic control unit and the ignition power module used for switching. The heater at issue dissipates an electric power P consuming electric energy I when submitted to an electric voltage E. Variations of the physical quantities mentioned may occur due to changes in application, i.e., in the volume or geometry of the fuel rail and/or tolerances in manufacturing/industrialization processes.

Figure 30:
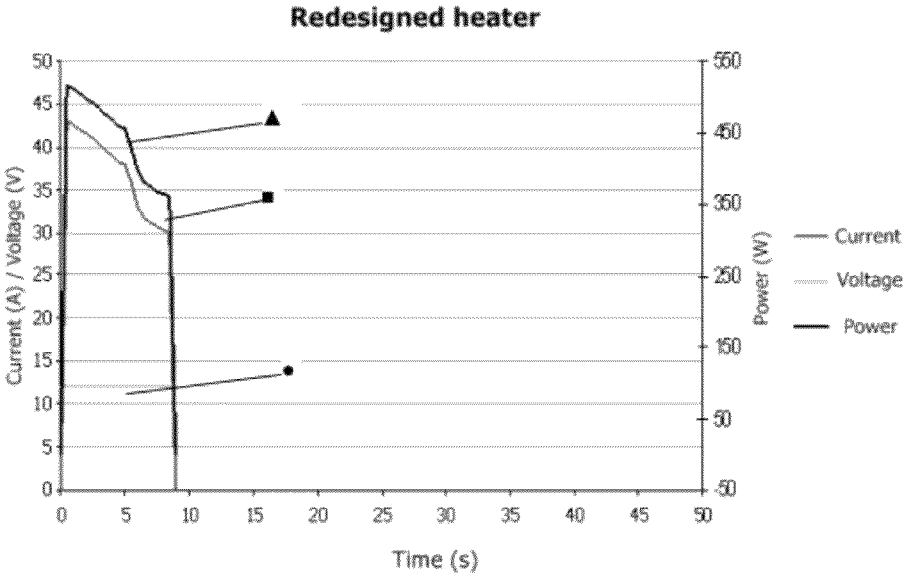
FIG. 30—refers to the work chart of the fuel heater, representing: the electric power curve of the heater in operation, the electric current curve of the heater in operation and the electric voltage curve of the heater in operation.

To better show the rate of efficiency of the solution disclosed by the present invention, tests have been made showing the operation of the fuel heater (1, 8), according to the chart in FIG. 30, which shows the electric power curve of the fuel heater in operation (▲), the electric current curve of the heater in operation (■) and the electric voltage curve of the heater in operation (∀).

The main benefits of the present invention are clear as described previously and include:

the safety feature (fuse effect) required to guarantee the integrity of the system in case of a possible control failure of the electronic control unit (ECU);

it allows its installation in rails made of polymeric materials;

its construction is relatively simple and inexpensive.

What is claimed is:

1. A fuel heater for cold ignition systems in vehicles provided with a reservoir, a fuel supply pump, feeding pipes to supply alcohol to a fuel rail for fuel distribution to intake manifold ducts, the fuel heater comprising: a connector (11, 111) housing a set of terminals (112) to receive electric energy from a battery and controlled by an electronic control unit by a power module with switching function; a heating element (17); an inner metal rod (14) to conduct electric current from the terminals (112) to the heating element (17); an insulating gasket (12) of the inner metal rod (14); a main metal body (13) for protection of the inner metal rod (14); and an external metal tube (18) involving an electric insulator (16) and the heating element (17), wherein the fuel heaters (1, 8) are positioned axially inside a rail body (5) of the fuel rail (203) and at one or both of its ends, and wherein the heating element (17) of each fuel heater (1, 8) presents a fuse effect.

* * * * *